US006902429B1

(12) United States Patent
Brooks

(10) Patent No.: US 6,902,429 B1
(45) Date of Patent: Jun. 7, 2005

(54) MULTIPLE ELECTRICAL OUTLET DEVICE

(76) Inventor: Frederick A. Brooks, 3490 Hollingsworth Rd., Macon, GA (US) 31210

( * ) Notice: Subject to any disclaimer, the term of this patent is extended or adjusted under 35 U.S.C. 154(b) by 0 days.

(21) Appl. No.: 10/901,786

(22) Filed: Jul. 29, 2004

(51) Int. Cl.[7] ..... H01R 13/66
(52) U.S. Cl. ..... 439/535; 439/106
(58) Field of Search ..... 439/106, 108, 439/535, 956, 222, 652, 653, 654, 650

(56) References Cited

U.S. PATENT DOCUMENTS

| | | | | |
|---|---|---|---|---|
| 2,450,657 A | | 10/1948 | Guernsey | |
| 2,989,719 A | | 6/1961 | Aarlaht | |
| 2,994,849 A | | 8/1961 | Mussari | |
| 3,349,363 A | | 10/1967 | Goodman | |
| 3,938,068 A | | 2/1976 | Hagan | |
| 3,997,225 A | | 12/1976 | Horwinski | |
| 4,085,996 A | | 4/1978 | Koslo | |
| 4,740,167 A | | 4/1988 | Millhimes et al. | |
| 4,911,649 A | | 3/1990 | Helmich | |
| 5,192,231 A | * | 3/1993 | Dolin, Jr. | 439/620 |
| 5,574,612 A | * | 11/1996 | Pak | 361/93.1 |
| 5,660,554 A | * | 8/1997 | Mead | 439/172 |
| 6,315,617 B1 | * | 11/2001 | Al-Sabah | 439/652 |

* cited by examiner

*Primary Examiner*—Briggitte R. Hammond
(74) *Attorney, Agent, or Firm*—Joseph G. Mitchell, Esq.

(57) ABSTRACT

The invention provides a housing that contains a 220 volt outlet receptacle and multiple 110 volt outlet receptacles. A 220 volt power cord supplies power to each of the receptacles. The invention is easy to use and allows for a very efficient use of the user's time because one 220 volt power cord supplies both a 220 volt outlet receptacle and multiple 110 volts outlet receptacles, so the user only has to use one cord to connect to multiple types of outlets.

8 Claims, 1 Drawing Sheet

MULTIPLE ELECTRICAL OUTLET DEVICE

BACKGROUND OF THE INVENTION

1. Field of the Invention

The field of invention relates to a multiple electrical outlet device. More particularly, the device provides for a 220 volt receptacle and multiple 110 volt receptacles that are connected to a 220 volt power cord. The 220 volt power cord supplies the power to the receptacles.

2. Description of Prior Art

The use of multiple electrical outlet strips is well known in the prior art to enable the attachment of various electrical devices into a single outlet source. It is understood that there are many 220 volt outlets that are not continuously utilized for servicing of such devices as air conditioners, stoves and the like. Accordingly, it is desired to utilize these outlets and convert the same into a plurality of 110 volt outlets for accommodating the myriad of electrical appliances requiring such voltage. Additionally, it is desired to also have a multiple electrical outlet strip not only accommodate 110 volt outlets but also a 220 volt outlet. Unfortunately, there are no such outlets on the market. The present invention, as opposed to the prior art, accommodates a plurality of 110 volt receptacles and a 220 volt receptacle while receiving power from a 220 volt outlet.

U.S. Pat. No. 3,349,363 to Goodman sets forth the overall teaching of converting 220 volt current to 110 volt current.

U.S. Pat. No. 3,938,068 to Hagan sets forth an electrical plug associated with a 220 volt type outlet including a fuse in a conductive path so the current flowing through the plug and outlet must flow through the fuse to ensure an element of safety. The patent is of interest relative to the overall teaching of converting 220 volt power to 110 volt power for subsequent utilization by an individual.

U.S. Pat. No. 3,997,225 to Horwinski utilizes a typical plug associated with a grounding screw securable to a typical outlet for providing multiple 110 volt type outlets from a 110 volt source.

U.S. Pat. No. 4,911,649 to Helmich, Jr. employs a removable face containing one of a plurality of various 220 volt connector plugs within a housing and converts and connects with a plurality of 110 volt outlets.

As such, it may be appreciated that there is a continuing need for a new and improved device which addresses both the problems of connecting to a 220 volt power supply to both a multiple number of 110 volt outlets and a 220 volt outlet all within the same housing. In this respect, the present invention substantially fulfills this need.

SUMMARY OF THE INVENTION

The purpose of the invention, then, is to provide the means to use a 220 volt power cord to supply power to both a 220 volt receptacle and a plurality of 110 volt receptacles.

The invention comprises a housing that contains a 220 volt receptacle and four 110 volt receptacles. Each receptacle has a first terminal, a second terminal and a ground terminal.

The 220 volt receptacle is placed in the center of the housing. Two of the 110 volt receptacles are placed on the left side of the housing. The other two 110 volt receptacles are placed on the right side of the housing.

A 220 volt power cord comprises a first wire, a second wire and a ground wire. The 220 volt power cord is in electrical communication with a 220 volt power outlet.

The first wire of the 220 volt power cord is in electrical communication with the second terminal of the 110 volt receptacles on the left side of the housing. The first wire of the 220 volt power cord is also in electrical communication with the first terminal of the 220 volt receptacle.

The second wire of the 220 volt power cord is in electrical communication with the second terminal of the 110 volt receptacles on the right side of the housing. The second wire of the 220 volt power cord is also in electrical communication with the second terminal of the 220 volt receptacle.

The ground wire of the 220 volt power cord is in electrical communication with the ground terminal of each receptacle. The ground wire of the 220 volt power cord is also electrical communication with the first terminal of the 110 volt receptacles in the left side of the housing. The ground wire of the 220 volt power cord is also electrical communication with the first terminal of the 110 volt receptacles in the right side of the housing.

The invention resides not in any one of these features per se, but rather in the particular combination of all of them herein disclosed and claimed, and it is distinguished from the prior art in this particular combination of all its structures for the functions specified.

There has thus been outlined, rather broadly, the important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

One objective of this invention, then, is to reduce the number of power cords and similar power supplies by combining one power cord into one unit with multiple and various types of receptacles.

A further objective of the invention is to provide an easy means to make and build the invention so that it is economical to purchase for the consuming public.

Yet another objective of the invention is to make it easy for the user so that the user does not have to have multiple electrical receptacle outlets using multiple power cords, but, rather, one power cord supplying multiple outlets contained in one housing.

Another objective of the invention is to expedite the time the user has to work so as to make the user efficient in his or her job.

A further objective of the invention is that it is very easy to use and is safe for the user.

BRIEF DESCRIPTION OF THE DRAWINGS

The invention will be better understood based on the following detailed description. Such description makes reference to the annexed drawings wherein.

DESCRIPTION OF THE PREFERRED EMBODIMENT

Figure 1:
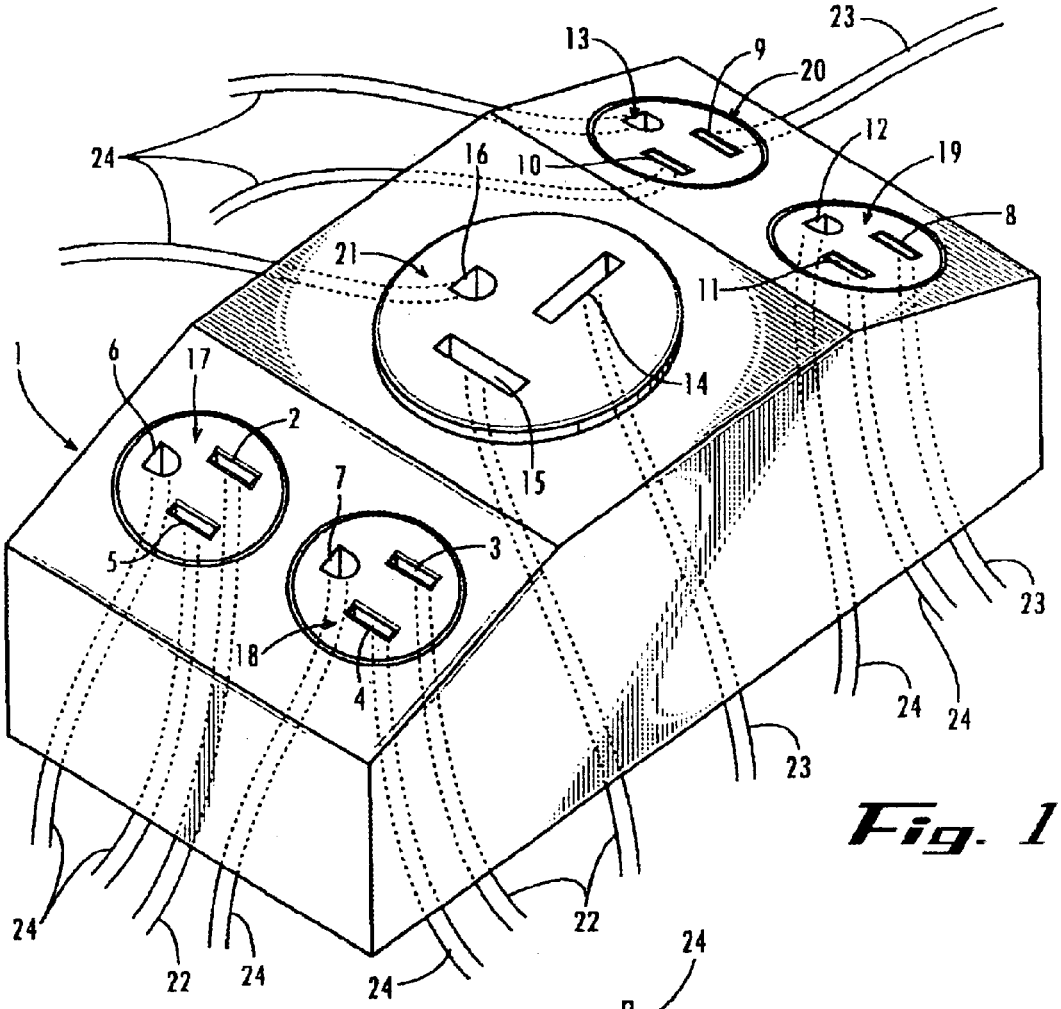
FIG. 1 shows the housing showing the receptacles and terminals of the receptacles therein.
Figure 2:
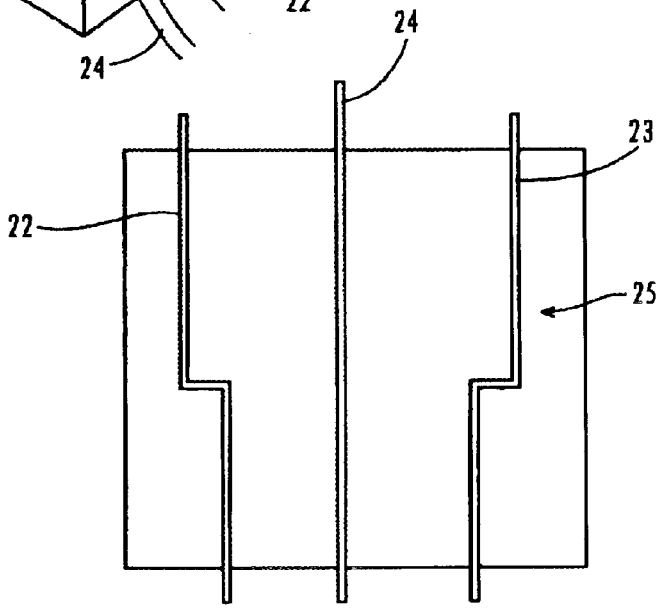
FIG. 2 shows the 220 volt power cord's wires.

With reference now to the drawings, and in particular FIGS. 1 and 2, the multiple electric outlet device shown therein embodies the principles and concepts of the present invention.

With reference to FIG. 2, then, the 220 volt power cord consists of two hot wires 22 and 23 and a ground wire 24. The wires, 22, 23 and 24 comprise a 220 volt power cord 25.

With reference to FIGS. 1 and 2, the invention comprises a housing 1 that contains a 220 volt receptacle 21 and four 110 volt receptacles 17, 18, 19 and 20. The 220 volt receptacle has a first terminal 15, and a second terminal 14 and a ground terminal 16. Each of the 110 receptacles have a first terminal 4, 5, 10 and 11; a second terminal 2, 3, 8, and 9; and, a ground terminal 6, 7, 12 and 13.

The 220 volt receptacle 21 is placed in the center of the housing 1. Two of the 110 volt receptacles 17 and 18 are placed on the left side of the housing 1. The other two 110 volt receptacles 19 and 20 are placed on the right side of the housing 1.

In FIG. 2, a 220 volt power cord 25 comprises a first wire 22, a second wire 23 and a ground wire 24. The 220 volt power cord 25 can be in electrical communication with a 220 volt power outlet.

The first wire 22 of the 220 volt power cord 25 is in electrical communication with the second terminals 2 and 3 of the 110 volt receptacles 17 and 18 on the left side of the housing 1. The first wire 22 of the 220 volt power cord 25 is also in electrical communication with the first terminal 15 of the 220 volt receptacle 21.

The second wire 23 of the 220 volt power cord 25 is in electrical communication with the second terminal 8 and 9 of the 110 volt receptacles 19 and 20 on the right side of the housing 1. The second wire 23 of the 220 volt power cord 25 is also in electrical communication with the second terminal 14 of the 220 volt receptacle 21.

The ground wire 24 of the 220 volt power cord 25 is in electrical communication with the ground terminal 6, 7, 12, 13 and 16 of each receptacle 17, 18, 19, 20 and 21. The ground wire 24 of the 220 volt power cord 25 is also electrical communication with the first terminal 4 and 5 of the 110 volt receptacles 17 and 18 in the left side of the housing 1. The ground wire 24 of the 220 volt power cord 25 is also electrical communication with the first terminal 10 and 11 of the 110 volt receptacles 20 and 19 in the right side of the housing 1.

With respect to the above description then, it is to be realized that the optimum dimensional relationships for the invention to include variations in size, materials, shape, form, function and manner of operation, assembly and use, are deemed readily apparent and obvious to one skilled in the art, and all equivalent relationships to those skilled in the art, and all equivalent relationships to those illustrated in the drawing and described in the specification are intended to be encompassed by the present invention.

Thus, foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A multiple electrical outlet device, comprising:

a 220 volt receptacle with a first terminal, second terminal and ground terminal;

at least two 110 volt receptacles each having a first terminal, second terminal, and a ground terminal;

a 220 volt power cord having a first wire, second wire and a ground wire;

a housing containing said 220 volt receptacle and said plurality of 110 volt receptacles;

said first wire of said 220 volt power cord is in electrical communication with said second terminal of one of said 110 volt receptacles and said first terminal of said 220 volt receptacle;

said second wire of said 220 volt power cord is in electrical communication with said second terminal of the other of said 110 volt receptacles and said second terminal of said 220 volt receptacle; and said ground wire of said 220 volt power cord is in electrical communication with said first terminal of each of said 110 volt receptacles and said ground terminal of said 110 volt receptacles and said ground wire of said 220 volt receptacle.

2. The device of claim 1, wherein said housing has an opening therein with a left side, middle and right side and at least one of said 110 volt receptacles is located on the left side of said housing.

3. The device of claim 1, wherein said housing has an opening therein with a left side, middle and right side and at least one of said 110 volt receptacles is located on the right side of said housing.

4. The device of claim 1, wherein said housing has an opening therein with a left side, middle and right side and said 220 volt receptacle is located in the middle of said housing.

5. A multiple electrical outlet device, comprising:

a 220 volt receptacle with a first terminal, second terminal and ground terminal;

four 110 volt receptacles each having a first terminal, second terminal, and a ground terminal;

a 220 volt power cord having a first wire, second wire and a ground wire;

a housing containing said 220 volt receptacle and said plurality of 110 volt receptacles;

said first wire of said 220 volt power cord is in electrical communication with said second terminal with two of said 110 volt receptacles and said first terminal of said 220 volt receptacle;

said second wire of said 220 volt power cord is in electrical communication with said second terminal of the other two of said 110 volt receptacles and said second terminal of said 220 volt receptacle; and said ground wire of said 220 volt power cord is in electrical communication with said first terminal of each of said 110 volt receptacles and said ground terminal of said 110 volt receptacles and said ground wire of said 220 volt receptacle.

6. The device of claim 5, wherein said housing has an opening therein with a left side, middle and right side and two of said 110 volt receptacles is located on the left side of said housing.

7. The device of claim 5, wherein said housing has an opening therein with a left side; middle and right side and two of said 110 volt receptacles is located on the right side of said housing.

8. The device of claim 5, wherein said housing has an opening therein with a left side, middle and right side and said 220 volt receptacle is located in the middle of said housing.

* * * * *